US011635196B2

(12) United States Patent
Chen et al.

(10) Patent No.: US 11,635,196 B2
(45) Date of Patent: Apr. 25, 2023

(54) SPLICING LAMP AND LAMP ADAPTER

(71) Applicant: Shenzhen Full Information Technology Co., Ltd., Shenzhen (CN)

(72) Inventors: Shifu Chen, Shenzhen (CN); Weiwei Lin, Shenzhen (CN)

(73) Assignee: Shenzhen Full Information Technology Co., Ltd., Shenzhen (CN)

( * ) Notice: Subject to any disclaimer, the term of this patent is extended or adjusted under 35 U.S.C. 154(b) by 50 days.

(21) Appl. No.: 17/467,066

(22) Filed: Sep. 3, 2021

(65) Prior Publication Data

US 2022/0397264 A1 Dec. 15, 2022

(30) Foreign Application Priority Data

Jun. 9, 2021 (CN) ..... 202121283127.0

(51) Int. Cl.

| | |
|---|---|
| ***F21V 23/06*** | (2006.01) |
| ***H01R 13/627*** | (2006.01) |
| ***H01R 31/06*** | (2006.01) |
| *F21Y 103/00* | (2016.01) |

(52) U.S. Cl.
CPC ..... *F21V 23/06* (2013.01); *H01R 13/6278* (2013.01); *H01R 31/06* (2013.01); *F21Y 2103/00* (2013.01)

(58) Field of Classification Search
CPC ..... H01R 31/06; H01R 13/6278; F21V 23/06
See application file for complete search history.

(56) References Cited

U.S. PATENT DOCUMENTS

| | | | | |
|---|---|---|---|---|
| 8,388,383 B2 * | 3/2013 | Tsai | ..... | H01R 31/06 439/628 |
| 11,296,468 B2 * | 4/2022 | Cheng | ..... | H01R 31/06 |

* cited by examiner

*Primary Examiner* — Briggitte R. Hammond
(74) *Attorney, Agent, or Firm* — Westbridge IP LLC

(57) ABSTRACT

Disclosed are a lamp adapter including a shell and a polar socket component for splicing and electrically connecting two adjacent lamps. The polar socket component is disposed in the shell, and a male head and a female head of the polar socket component are positioned on a first side of the shell and a second side of the shell, respectively; the first side and the second side are positioned on two sides in an X-axis direction or two sides in a Y-axis direction of the shell. According to the present invention, two adjacent lamps are electrically connected with neat appearance, improved safety, and a stable structure.

13 Claims, 9 Drawing Sheets

SPLICING LAMP AND LAMP ADAPTER

CROSS-REFERENCE TO RELATED APPLICATIONS

The present application claims priority to Chinese Patent Application No. 202121283127.0 filed on Jun. 9, 2021, which is incorporated herein by reference in its entirety.

TECHNICAL FIELD

The invention relates to the field of lamps, and more particularly, to a splicing lamp and a lamp adapter.

BACKGROUND

To make it possible a larger illuminated area of a lamp, people may connect lighting facilities through wires to form a set of lamps connected in rows. However, such a connection has low reliability, the lamps are easy to fall when interfered with external force, the aesthetic aspects are affected due to exposed wires, and the waterproof and moisture-proof performance of the lamps connected through the wires is poor, which brings hidden troubles of safety.

SUMMARY

It is an object of the present invention to improve the safety of a lamp on the premise that a larger illuminated area of the lamp is made available by providing a splicing lamp and a lamp adapter.

To achieve the above object, the present invention is implemented according to a technical solution as follows.

A lamp adapter comprises a shell and a polar socket component used for splicing and electrically connecting two adjacent lamps. The polar socket component is disposed in the shell, and a male head and a female head of the polar socket component are positioned on a first side of the shell and a second side of the shell, respectively. The first side and the second side are positioned on two opposite sides of the shell, respectively.

Further, the male head and the female head are arranged in a staggered configuration.

Further, a splicing column capable of being plugged into a lamp holder of the lamp is provided on the first side and the second side, respectively.

Further, the male head and the female head are arranged to protrude outwards from the first side and the second side, respectively.

Further, the shell comprises an upper shell and a lower shell; and the upper shell is detachably connected with the lower shell.

Further, a first limiting component and a second limiting component are provided on the lower shell; and the male head is snapped into the first limiting component, and the female head is snapped into the second limiting component.

Further, the first limiting component comprises two first limiting columns which are oppositely arranged; a neck matched with the first limiting column is provided on two sides of the male head in a Y-axis direction, respectively; and the two first limiting columns are plugged into corresponding necks, respectively, to limit the male head.

To achieve the above object, the present invention is implemented according to another technical solution as follows.

A splicing lamp comprises an illuminant, a first lamp holder and a second lamp holder. The first lamp holder and the second lamp holder are arranged at two ends of the illuminant in an X-axis direction and are electrically connected with the illuminant. A first female seat capable of being connected with the male head and a first male plug capable of being connected with the female head are provided on a side, away from the second lamp holder, of the first lamp holder, and a second male plug and a second female seat are provided on two sides of the first lamp holder in the Y-axis direction, respectively. A third female seat capable of being connected with the female head is provided on a side, away from the first lamp holder, of the second lamp holder.

Further, a first splicing socket for allowing the shell to be plugged in is provided on the two sides in the Y-axis direction and the side away from the second lamp holder of the first lamp holder, respectively; and a second splicing socket for allowing the shell to be plugged in is provided on two sides in the Y-axis direction and a side away from the first lamp holder of the second lamp holder, respectively.

The present invention is advantageous in that a polar socket component is provided on a shell to splice two adjacent lamps positioned respectively on two sides of the shell and to connect the two adjacent lamps electrically, thereby rendering circuit conductivity and replacing a wire connection by which the lamps are conventionally spliced and electrically connected, hence the safety and reliability of the lamp set is improved. The male head and the female head are arranged on two opposite sides of the shell, respectively, so that splicing in a larger range, namely, splicing and electrical connection of the lamp set in multiple directions can be realized, and in turn the illuminated area is further expanded.

DETAILED DESCRIPTION OF THE EMBODIMENTS

Figure 1:
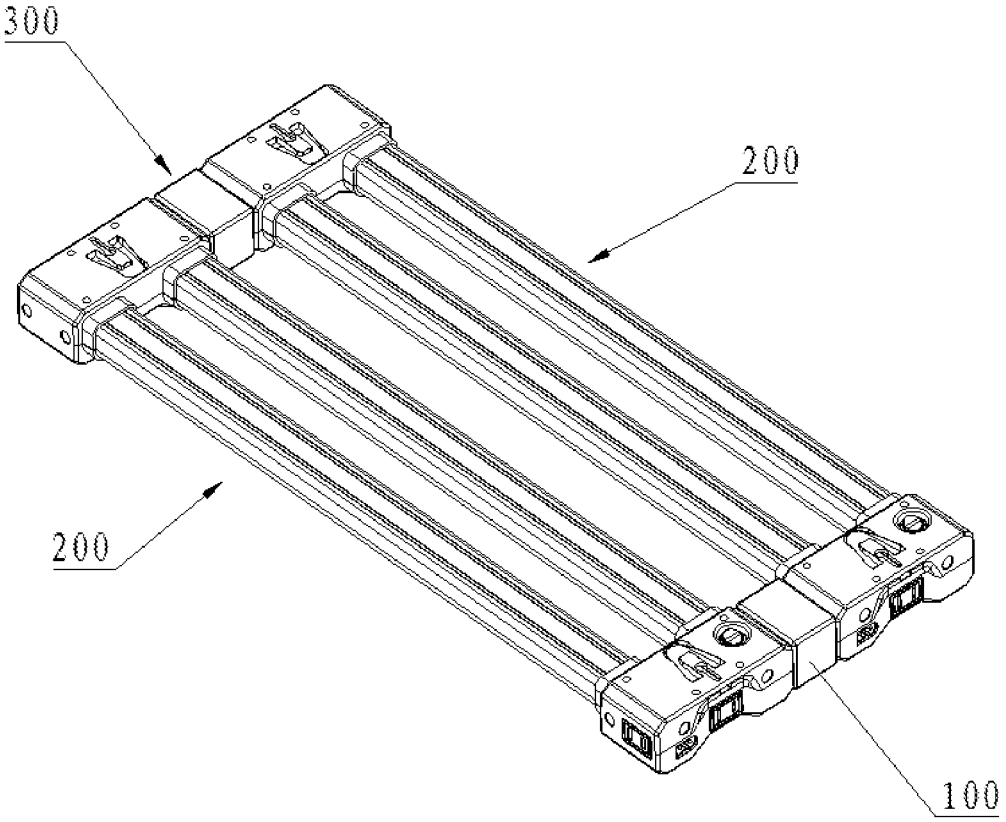
FIG. 1 is a schematic diagram showing a structure of a splicing lamp and a lamp adapter in Embodiment 2 of the present invention.

To explain the technical solutions, object and effects of the present invention in detail, the following description is provided with reference to the embodiments, taken in conjunction with the accompanying drawings.

Referring to FIGS. 1 to 7, a lamp adapter includes a shell and a polar socket component for splicing and electrically connecting two adjacent lamps.

The polar socket component is disposed in the shell, and a male head and a female head of the polar socket component are positioned on a first side of the shell and a second side of the shell, respectively.

The first side and the second side are positioned on two sides in an X-axis direction or two sides in a Y-axis direction of the shell.

As can be seen from the above description, the present invention is advantageous in that a polar socket component is provided on a shell to splice two adjacent lamps positioned respectively on two sides of the shell and to connect the two adjacent lamps electrically, thereby rendering circuit conductivity and replacing a wire connection by which the lamps are conventionally spliced and electrically connected, hence the safety and reliability of the lamp set is improved. The male head and the female head are arranged on two opposite sides of the shell, respectively, so that splicing in a larger range, namely, splicing and electrical connection of the lamp set in multiple directions can be realized, and in turn the illuminated area is further expanded.

Further, the male head and the female head are arranged in a staggered configuration.

As can be seen from the above description, the male head and the female head are arranged in a staggered configuration to achieve the fool-proof effect and guide the action of plug-in of the male head and the female head, hence mis-operation is effectively prevented, and the plug-in efficiency is improved.

Further, a splicing column capable of being plugged into a lamp holder of the lamp is provided on the first side and the second side, respectively.

As can be seen from the above description, a splicing column is provided for enhancing the tightness of the connection between the two adjacent lamps and thus improving the reliability of the connection.

Further, the male head and the female head are arranged to protrude outwards from the first side and the second side, respectively.

As can be seen from the above description, the male head and the female head are arranged to protrude outwards to facilitate the action of plug-in.

Further, the shell includes an upper shell and a lower shell; and the upper shell is detachably connected with the lower shell.

Further, a first limiting component and a second limiting component are provided on the lower shell; and the male head is snapped into the first limiting component, and the female head is snapped into the second limiting component.

As can be seen from the above description, the first limiting component and the second limiting component are provided to limit the male head and the female head, respectively, so that the stability of the male head and the female head and the overall structural reliability of the connection are improved.

Further, the first limiting component comprises two first limiting columns which are oppositely arranged; a neck matched with the first limiting column is provided on two sides of the male head in a Y-axis direction, respectively; and the two first limiting columns are plugged into corresponding necks, respectively, to limit the male head.

As can be seen from the above description, the limiting column is combined with the neck to limit the male head, and the reliability is higher.

Figure 8:
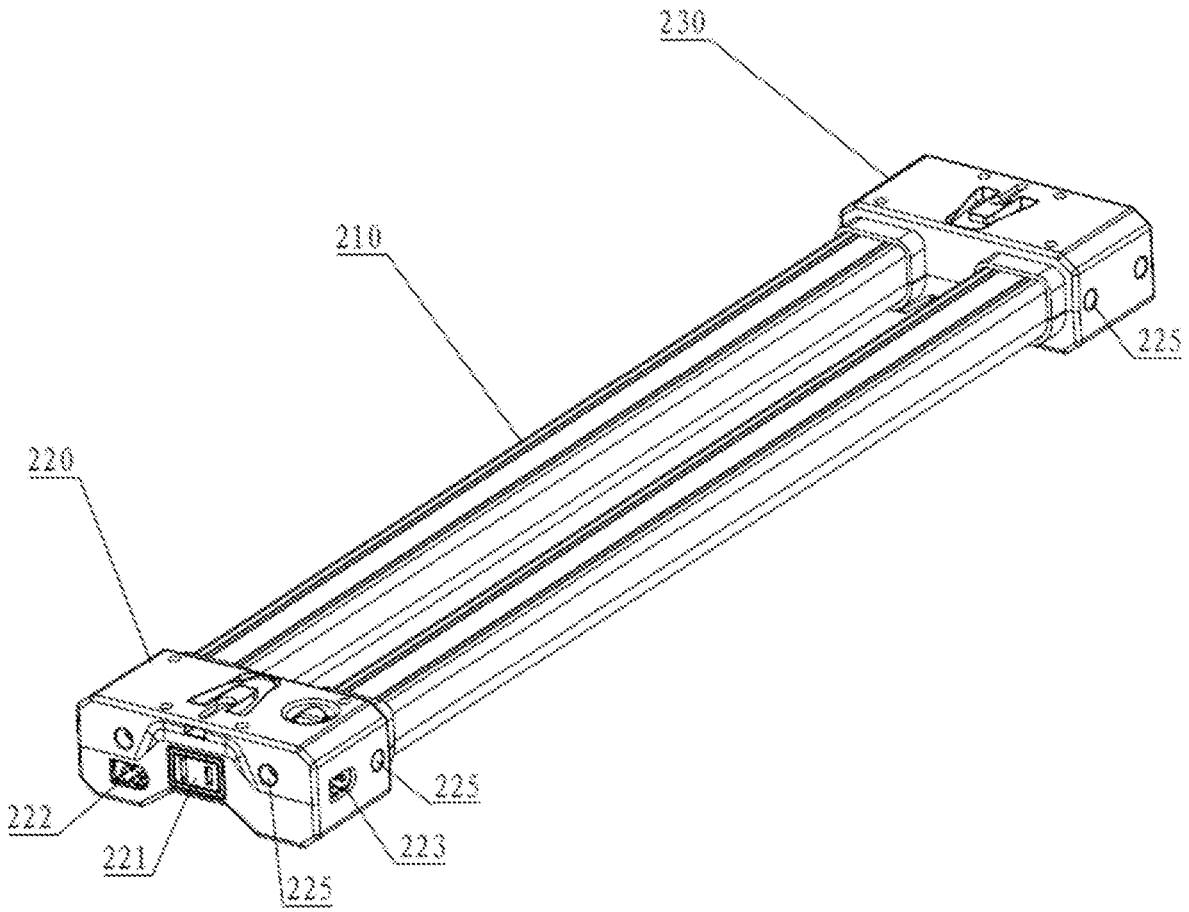
FIG. 8 is a schematic diagram (I) showing a structure of a splicing lamp in Embodiment 5 of the present invention.
Figure 9:
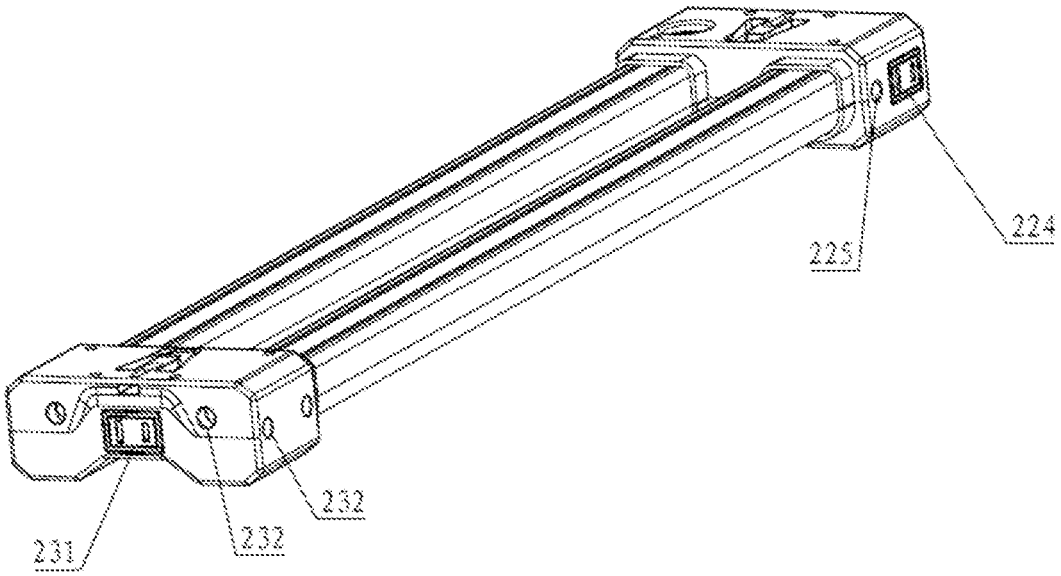
FIG. 9 is a schematic diagram (II) showing a structure of a splicing lamp according to Embodiment 5 of the present invention.

Referring to FIGS. 8 and 9, a splicing lamp includes an illuminant, a first lamp holder, and a second lamp holder.

The first lamp holder and the second lamp holder are arranged at two ends of the illuminant in an X-axis direction and are electrically connected with the illuminant.

A first female seat capable of being connected with the male head and a first male plug capable of being connected with the female head are provided on a side, away from the second lamp holder, of the first lamp holder, and a second male plug and a second female seat are provided on two sides of the first lamp holder in the Y-axis direction, respectively.

A third female seat capable of being connected with the female head is provided on a side, away from the first lamp holder, of the second lamp holder.

As can be seen from the above description, the present invention is advantageous in that a first male plug and a first female seat are provided so that the first lamp holder can be connected with either the male head or the female head, and thus the adaptability of the first lamp holder is better; and a second female base and a second male plug are provided so that the first lamp holders can be spliced in the Y-axis direction, hence the illuminated area of the lamp set can be expanded.

Further, a first splicing socket for allowing the shell to be plugged in is provided on the two sides in the Y-axis direction and the side away from the second lamp holder of the first lamp holder, respectively; and a second splicing socket for allowing the shell to be plugged in is provided on two sides in the Y-axis direction and a side away from the first lamp holder of the second lamp holder, respectively.

As can be seen from the above description, a first splicing socket and a second splicing socket are provided for enhancing the tightness of the connections between the shell and the first lamp holder and between the shell and the second lamp holder.

Embodiment 1

Figure 2:
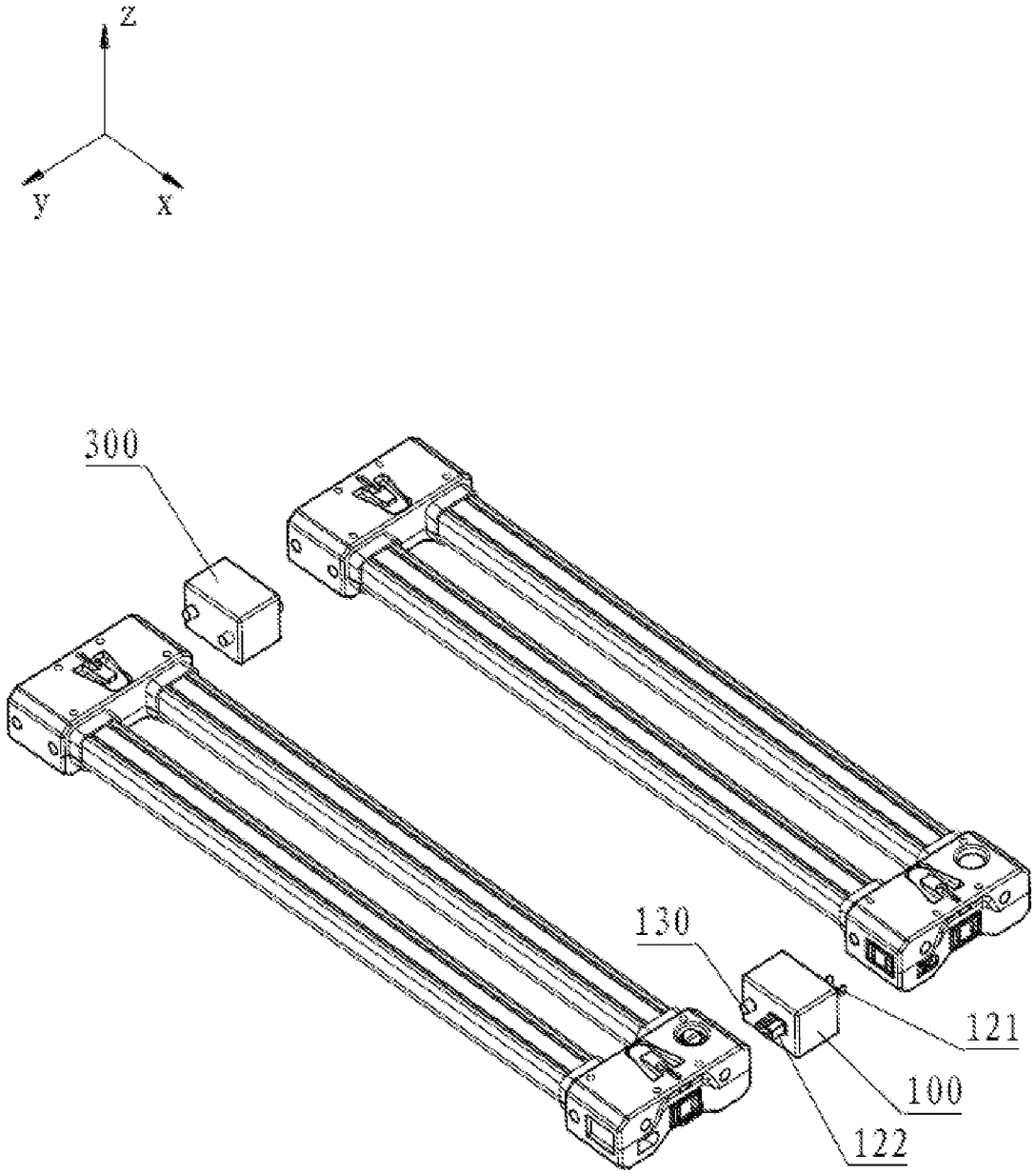
FIG. 2 is an exploded diagram of the splicing lamp and the lamp adapter in Embodiment 2 of the present invention.

Referring to FIGS. 1 to 8, a lamp adapter 100 includes a shell 110 and a polar socket component 120 for splicing and electrically connecting two adjacent lamps 200; the polar socket component 120 is disposed in the shell 110, and a male head 121 and a female head 122 of the polar socket component 120 are provided on a first side 111 of the shell 110 and a second side 112 of the shell 110, respectively; the first side 111 and the second side 112 are positioned on opposite sides of the shell 110, respectively, and the opposite sides of the shell 110 are specifically two sides in an X-axis direction or two sides in a Y-axis direction of the shell, where the X-axis and the Y-axis are shown in the coordinate system of FIG. 2 as a reference.

Embodiment 2

Figure 3:
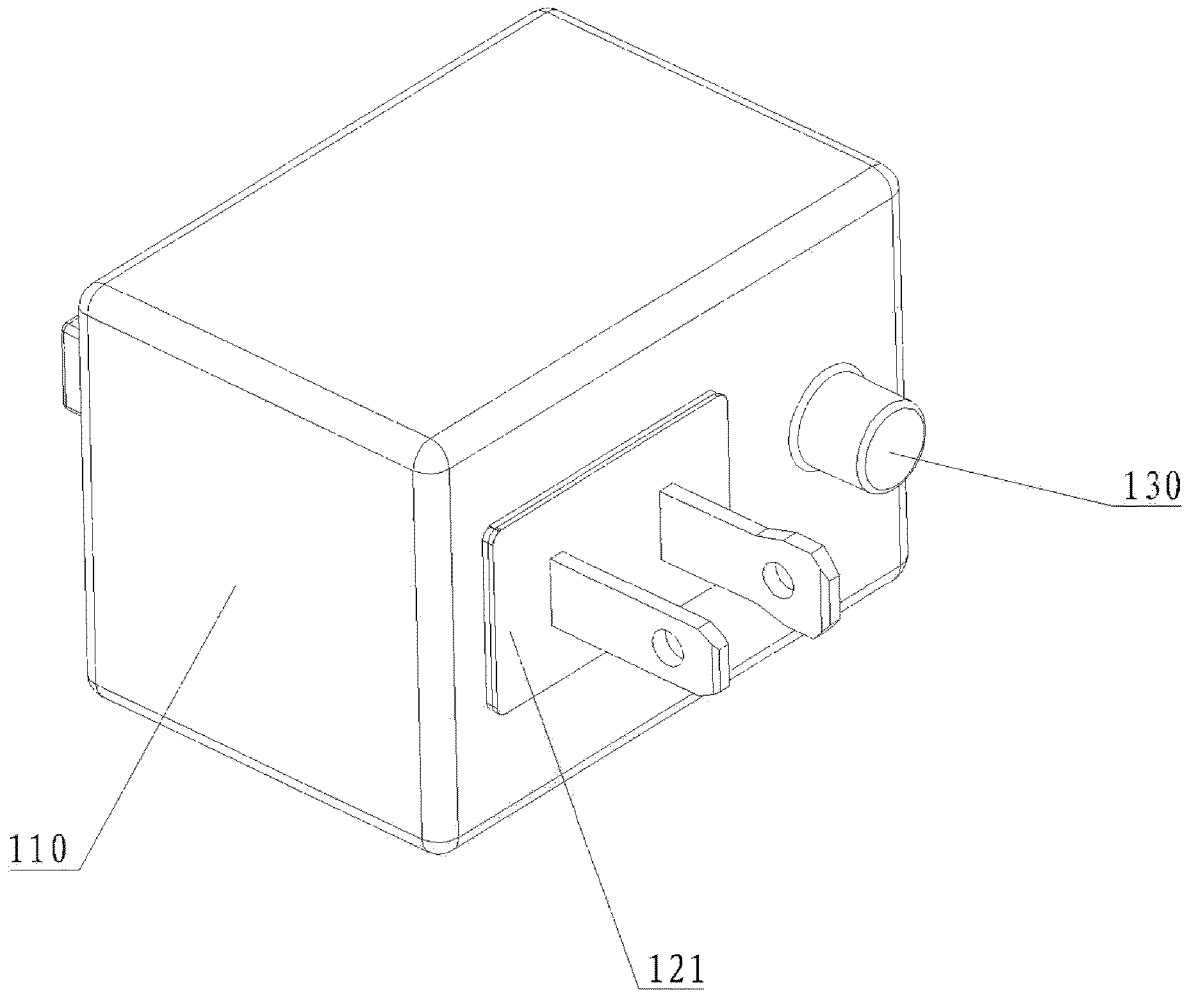
FIG. 3 is a schematic view showing the structure of the lamp adapter in Embodiment 2 of the present invention.

Referring to FIGS. 1 to 3, on the basis of Embodiment 1, the male head 121 and the female head 122 are in the same line in the Y-axis direction.

Referring to FIGS. 1 to 3, in the present embodiment, the first side 111 and the second side 112 are positioned on two sides in the Y-axis direction of the shell 110, and a splicing column 130 capable of being plugged into a lamp holder of the lamp 200 is provided on the first side 111 and the second side 112, respectively. Specifically, one splicing column 130 is provided on the first side 111 and the second side 112, respectively.

Referring to FIGS. 1 to 3, the male head 121 and the female head 122 are provided to protrude outwards from the first side 111 and the second side 112, respectively.

Referring to FIGS. 1 to 3, in the present embodiment, the adapter 100 is used to connect two lamps 200 side by side in parallel in the Y-axis direction, specifically, the adapter 100 is electrically connected to an end of the two lamps 200, respectively, and the other ends of the two lamps 200 are connected by a splicing socket 300 having no electrical connection.

Embodiment 3

Figure 4:
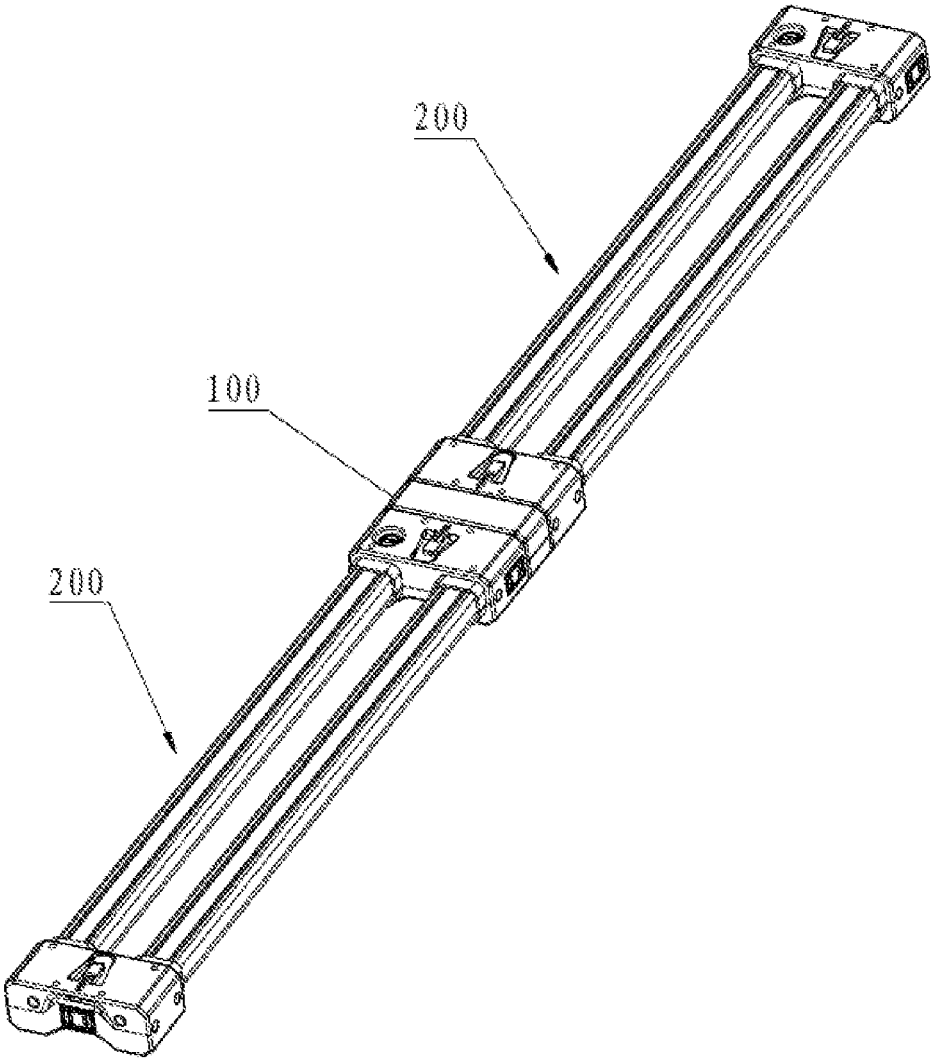
FIG. 4 is a schematic diagram showing a structure of a splicing lamp and a lamp adapter in Embodiment 3 of the present invention.
Figure 5:
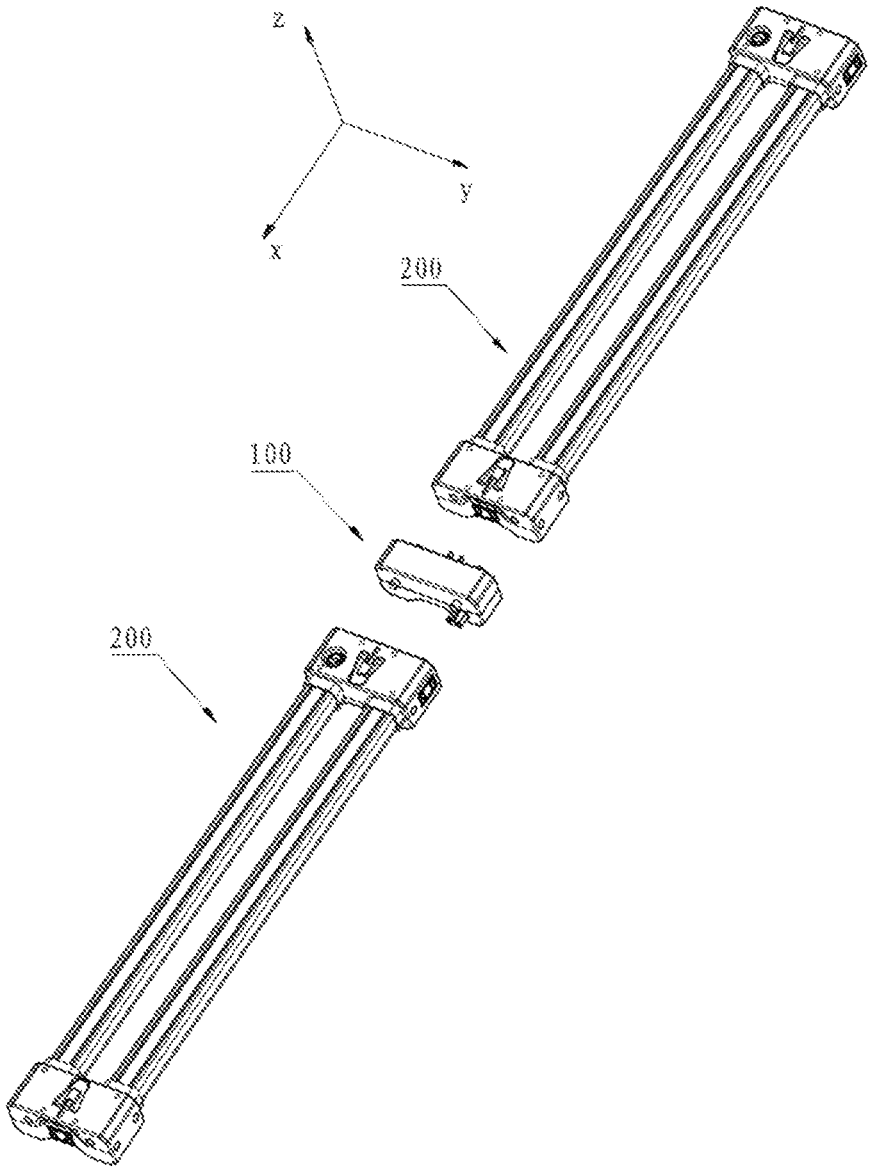
FIG. 5 is an exploded diagram of the splicing lamp and the lamp adapter in Embodiment 3 of the present invention.
Figure 6:
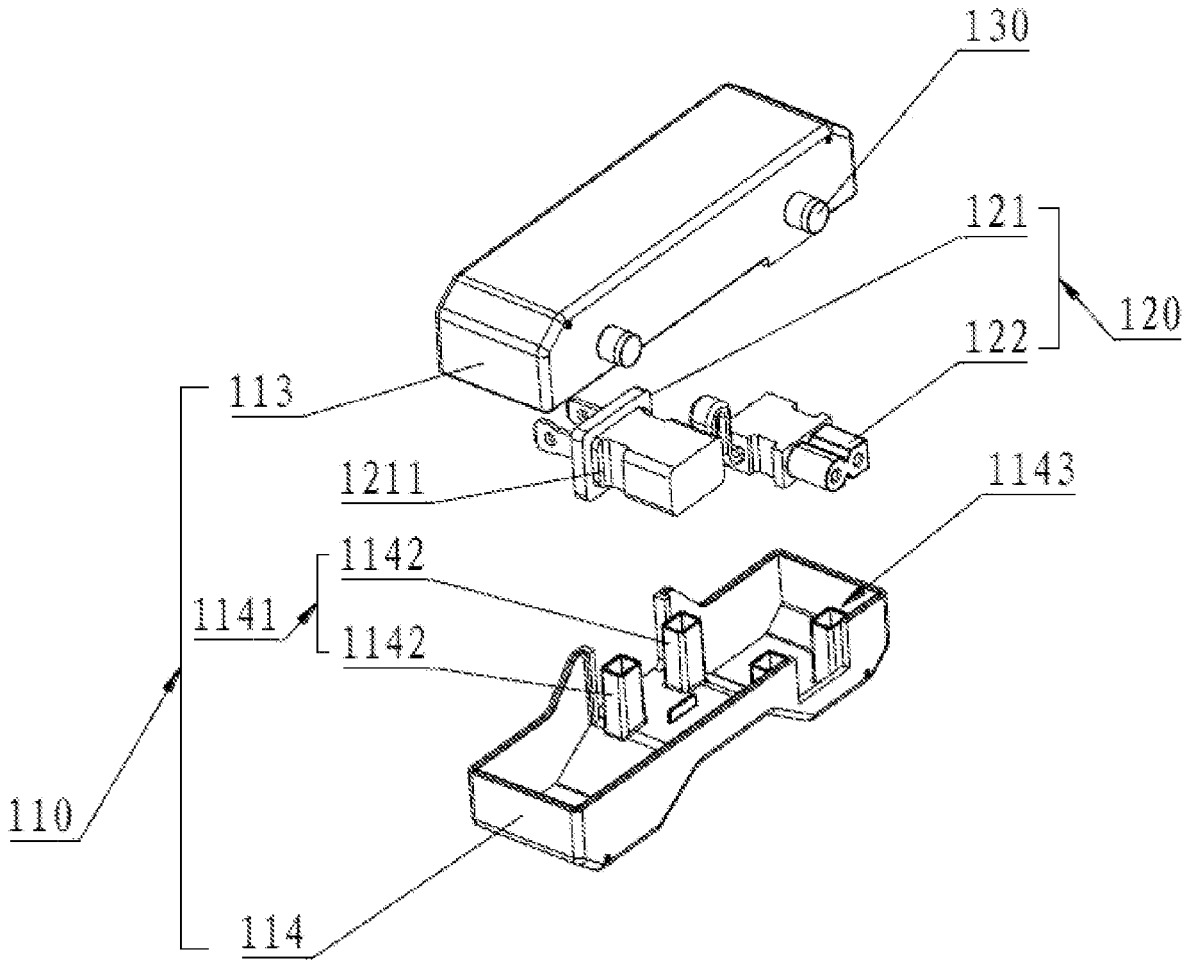
FIG. 6 is an exploded view of the lamp adapter in Embodiment 3 of the present invention.

Referring to FIGS. 4 to 6, on the basis of Embodiment 1, the male head 121 and the female head 122 are arranged in a staggered configuration in the X-axis direction. The male head 121 and the female head 122 are so arranged that a fool-proof structure is formed, hence a good guidance effect is enabled in the electrical connection, and the object of preventing mis-operation is realized.

Referring to FIGS. 4 to 6, in the present embodiment, the first side 111 and the second side 112 are positioned on two sides in the X-axis direction of the shell 110, and the splicing column 130 capable of being plugged into the lamp holder of the lamp 200 is provided on the first side 111 and the second side 112, respectively. Specifically, two splicing columns 130 are provided on the first side 111 and the second side 112, respectively, and both the splicing columns 130 are provided on the upper shell 113.

Referring to FIGS. 4 to 6, the shell 110 includes the upper shell 113 and a lower shell 114; the upper shell 113 is detachably connected with the lower shell 114.

Referring to FIGS. 4 to 6, a first limiting component 1141 and a second limiting component 1143 are provided on the lower shell 114; and the male head 121 is snapped into the first limiting component 1141 and the female head 122 is snapped into the second limiting component 1143 for limiting the male head 121 and the female head 122. Here, the second limiting component 1143 has the same structure as the first limiting component 1141 and the structure will not be described in detail.

Referring to FIGS. 4 to 6, the first limiting component 1141 includes two first limiting columns 1142 which are oppositely arranged; a neck 1211 matched with the first limiting column 1142 is provided on two sides of the male head 121 in the Y-axis direction, respectively; the two first limiting columns 1142 can be plugged into corresponding necks 1211, respectively, to limit the male head 121.

Referring to FIGS. 4 to 6, in the present embodiment, the adapter 100 is used to connect two lamps 200 in series in the X-axis direction.

Embodiment 4

Figure 7:
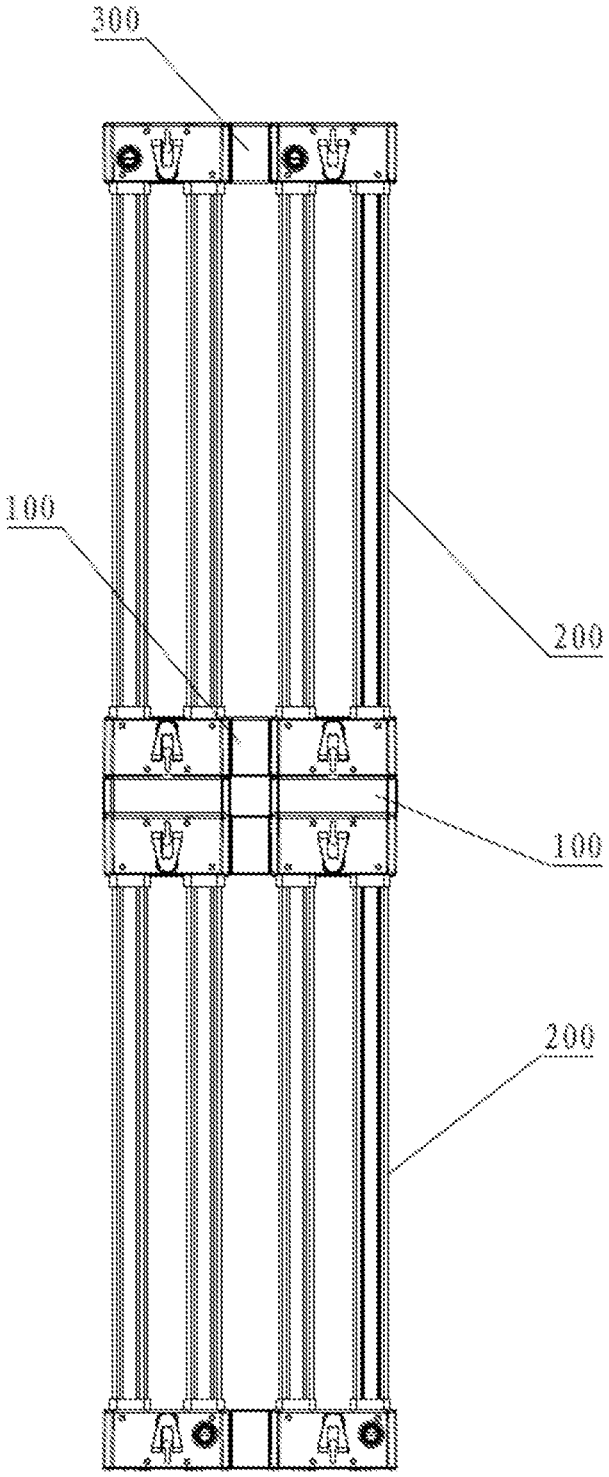
FIG. 7 is a top view of a splicing lamp and a lamp adapter in Embodiment 4 of the present invention.

Referring to FIG. 7, in the present embodiment, four lamps 200 are spliced as a whole by means of the adapter 100 and the splicing socket 300 in Embodiments 2 and 3.

Embodiment 5

Referring to FIGS. 8 and 9, a splicing lamp 200 includes an illuminant 210, a first lamp holder 220, and a second lamp holder 230; the first lamp holder 220 and the second lamp holder 230 are arranged at two ends of the illuminant 210 in the X-axis direction and are electrically connected with the illuminant 210; a first female seat 221 capable of being connected with the male head 121 and a first male plug 222 capable of being connected with the female head 122 are provided on a side, away from the second lamp holder 230, of the first lamp holder 220, and a second male plug 223 and a second female seat 224 are provided, respectively, on two sides, in the Y-axis direction, of the first lamp holder 220; a third female socket 231 capable of being connected to the female socket 122 is provided on a side, away from the first burner 220, of the second holder 230.

Referring to FIGS. 8 and 9, a first splicing socket 225 for allowing the shell 110 to be plugged in is provided on the two sides in the Y-axis direction and the side away from the second lamp holder 230 of the first lamp holder 220, respectively; and a second splicing socket 232 for allowing the shell 110 to be plugged in is provided on two sides in the Y-axis direction and a side away from the first lamp holder 220 of the second lamp holder 230, respectively.

In summary, the lamp adapter provided by the present invention integrates the polar plug socket and the shell with the splicing column to connect two adjacent lamps in series or in parallel, so that the structure of the resulting lamp set is stable and features high reliability is high; and the polar plug socket, in a hidden design, brings about improved aesthetic aspects and safety than exposed wiring.

The above description is merely exemplary of the present invention and is not intended to limit the scope of the present invention, any equivalents or modifications made from the description and accompanying drawings of the present invention, either directly or indirectly applied in the related art, shall fall within the scope of the appended claims.

What is claimed is:

1. A lamp adapter, comprising a shell and a polar socket component used for splicing and electrically connecting two adjacent lamps;

wherein the polar socket component is disposed in the shell, and a male head and a female head of the polar socket component are positioned on a first side of the shell and a second side of the shell, respectively;

the first side and the second side are positioned on two opposite sides of the shell, respectively; and a splicing column capable of being plugged into a lamp holder of the lamp is provided on the first side and the second side, respectively.

2. The lamp adapter according to claim 1, wherein the male head and the female head are arranged in a staggered configuration.

3. The lamp adapter according to claim 1, wherein the male head and the female head are arranged to protrude outwards from the first side and the second side, respectively.

4. The lamp adapter according to claim 1, wherein the shell comprises an upper shell and a lower shell; and the upper shell is detachably connected with the lower shell.

5. The lamp adapter according to claim 4, wherein a first limiting component and a second limiting component are provided on the lower shell; and the male head is snapped into the first limiting component, and the female head is snapped into the second limiting component.

6. The lamp adapter according to claim 5, wherein the first limiting component comprises two first limiting columns which are oppositely arranged;

a neck matched with the first limiting column is provided on two sides of the male head in a Y-axis direction, respectively; and the two first limiting columns are plugged into corresponding necks, respectively, to limit the male head.

7. A splicing lamp applied to the lamp adapter according to claim 1, comprising an illuminant, a first lamp holder and a second lamp holder;

wherein the first lamp holder and the second lamp holder are arranged at two ends of the illuminant in an X-axis direction and are electrically connected with the illuminant;

a first female seat capable of being connected with the male head and a first male plug capable of being connected with the female head are provided on a side, away from the second lamp holder, of the first lamp holder, and a second male plug and a second female seat are provided on two sides of the first lamp holder in the Y-axis direction, respectively; and a third female seat capable of being connected with the female head is provided on a side, away from the first lamp holder, of the second lamp holder.

8. The splicing lamp according to claim 7, wherein a first splicing socket for allowing the shell to be plugged in is provided on the two sides in the Y-axis direction and the side away from the second lamp holder of the first lamp holder, respectively; and a second splicing socket for allowing the shell to be plugged in is provided on two sides in the Y-axis direction and a side away from the first lamp holder of the second lamp holder, respectively.

9. The splicing lamp according to claim 7, wherein the male head and the female head are arranged in a staggered configuration.

10. The splicing lamp according to claim 7, wherein the male head and the female head are arranged to protrude outwards from the first side and the second side, respectively.

11. The splicing lamp according to claim 7, wherein the shell comprises an upper shell and a lower shell; and the upper shell is detachably connected with the lower shell.

12. The splicing lamp according to claim 11, wherein a first limiting component and a second limiting component are provided on the lower shell; and the male head is snapped into the first limiting component, and the female head is snapped into the second limiting component.

13. The splicing lamp according to claim 12, wherein the first limiting component comprises two first limiting columns which are oppositely arranged;

a neck matched with the first limiting column is provided on two sides of the male head in a Y-axis direction, respectively; and the two first limiting columns are plugged into corresponding necks, respectively, to limit the male head.

* * * * *